US009707526B2

(12) United States Patent
Song et al.

(10) Patent No.: US 9,707,526 B2
(45) Date of Patent: Jul. 18, 2017

(54) STIRRER HAVING RECESSES FORMED INSIDE CONTAINER

(71) Applicant: LG CHEM, LTD., Seoul (KR)

(72) Inventors: Young Soo Song, Daejeon (KR); Yu Shik Hong, Daejeon (KR); Jun Won Choi, Daejeon (KR); Ye Hoon Im, Daejeon (KR)

(73) Assignee: LG CHEM, LTD., Seoul (KR)

( * ) Notice: Subject to any disclaimer, the term of this patent is extended or adjusted under 35 U.S.C. 154(b) by 46 days.

(21) Appl. No.: 14/438,806

(22) PCT Filed: May 12, 2014

(86) PCT No.: PCT/KR2014/004230
§ 371 (c)(1),
(2) Date: Apr. 27, 2015

(87) PCT Pub. No.: WO2014/182142
PCT Pub. Date: Nov. 13, 2014

(65) Prior Publication Data

US 2015/0290603 A1 Oct. 15, 2015

(30) Foreign Application Priority Data

May 10, 2013 (KR) ..... 10-2013-0053411

(51) Int. Cl.
*B01F 7/00* (2006.01)
*B01F 7/18* (2006.01)
*B01F 15/00* (2006.01)

(52) U.S. Cl.
CPC ..... *B01F 7/00816* (2013.01); *B01F 7/183* (2013.01); *B01F 15/00883* (2013.01)

(58) Field of Classification Search
CPC ..... B01F 7/00816
USPC ..... 366/302, 207
See application file for complete search history.

(56) References Cited

U.S. PATENT DOCUMENTS 30,375 A * 10/1860 Gray ..... B01F 7/1675 366/307
735,206 A * 8/1903 Burrows ..... B01F 13/0211 366/102
3,471,131 A * 10/1969 Fritzweiler et al. B01F 7/00816 241/260

FOREIGN PATENT DOCUMENTS

| | | |
|---|---|---|
| JP | 2000238785 | 9/2000 |
| JP | 2001219047 | 8/2001 |
| JP | 3179398 | 10/2012 |
| KR | 200139216 | 4/1999 |
| KR | 101167083 | 7/2012 |

* cited by examiner

*Primary Examiner* — David Sorkin
(74) *Attorney, Agent, or Firm* — Dentons US LLP

(57) ABSTRACT

The present invention relates to a stirrer having grooves formed on the inside of a container in order to improve the degree of mixing, and the stirrer which is provided comprises: a plurality of projections formed on the inner surface of a stirrer container; and a plurality of grooves formed between the plurality of projections.

8 Claims, 2 Drawing Sheets

STIRRER HAVING RECESSES FORMED INSIDE CONTAINER

This application is a National Stage Application of International Application No. PCT/KR2014/004230, filed May 12, 2014, and claims the benefit of Korean Patent Application No. KR 10-2013-0053411, filed May 10, 2013, all of which are hereby incorporated by reference in their entirety for all purposes as if fully set forth herein.

TECHNICAL FIELD

The present invention relates to a stirrer, and more particularly, to a stirrer having a plurality of projections and grooves, which are alternately formed on an inner surface of a stirrer container, to enable a degree of vertical mixing to be improved.

BACKGROUND ART

A stirrer is the term representing an instrument for stirring and mixing liquid and liquid, liquid and solid, or powder. According to a kind of stirring, the stirrer may be classified into a tank type stirrer and a flowing type stirrer. Currently, most of stirrers which have been widely used are the tank type stirrer. The tank type stirrer has a structure in which a device for stirring an object is mounted in a tank, and may be classified into various kinds such as a propeller type stirrer, an oar type stirrer, a turbine type stirrer, and a spiral shaft type stirrer according to a shape of a stirring blade.

The propeller type stirrer is used for stirring liquid having a low viscosity or liquid containing solid particles. The oar type stirrer has the simplest structure for stirring objects having a low viscosity. The turbine type stirrer utilizes a centrifugal force and is very efficient. The spiral shaft type stirrer is employed for stirring objects having a high viscosity. A movement of liquid in the stirrer has a large influence on a stirring effect, and the movement of liquid is variously influenced by a shape of a container, a shape and a position of the stirrer, and an existence/nonexistence of a baffle (baffle plate). In general, the stirrer including the baffle provides a good stirring effect. In a chemical industry field, the stirrer is mainly for a chemical reaction, is used for combining, dissolving, cleaning, dispersing, and adsorbing substances, and is used for transferring heat. A household washing machine is one kind of the stirrer. Additionally, a movable stirrer in which fluid is pumped by a pump and is then stirred is employed, and this movable stirrer is suitable for continuously mixing liquids having a low viscosity.

In general, a flow formed by the stirrer is strongly formed in the rotational direction of the stirrer, and thus the strength of the flow in the upward/downward direction of the stirrer container is weaker than that of the flow in the rotational direction. Due to the above, a degree of mixing in the upward/downward direction of the stirring container is low, and a stirrer in which a plate-shaped baffle is installed has been proposed in order to improve the above problem. However, in the stirrer in which the plate-shaped baffle is installed, a region in which a flow velocity is rapidly reduced is formed around the baffle, foreign substances are generated around the baffle and an internal structure or an inner surface of the container, and shapes of particles are irregular due to a rapid change of the internal flow in the stirrer.

DISCLOSURE

Technical Problem

An object of the present invention is to provide a stirrer which minimizes a deformation of a flow pattern in a conventional stirrer, prevents a flow stagnation region from being generated, and can enhance a degree of mixing.

Technical Solution

In order to achieve the above object, the present invention provides a stirrer including a plurality of projections formed on an inner surface of a stirrer container; and a plurality of grooves, each of grooves being formed between the projections.

In the present invention, the plurality of projections may be spirally arranged.

In the present invention, each of the plurality of projections may independently have a semi-circular cross-sectional shape, a semi-elliptical cross-sectional shape, or a polygonal cross-sectional shape.

In the present invention, each of the plurality of projections may be independently inclined with respect to a vertical plane of the container.

In the present invention, an angle between each of the plurality of projections and the vertical plane of the container may be 10 to 70°.

In the present invention, a length of each of the plurality of projections may be independently 75 to 500% of a length of the container.

In the present invention, a height of each of the plurality of projections may be independently 0.5 to 20% of a diameter of the container.

In the present invention, a width of each of the plurality of projections may be independently 0.5 to 40% of a diameter of the container.

In the present invention, a distance between the projections may be independently 1 to 160% of a diameter of the container.

In the present invention, a width of the plurality of grooves may be 50 to 1000% of a width of the plurality of projections.

In the present invention, the number of the projections may be 2 to 100.

The stirrer according to the present invention may further include a propeller or an impeller, and the height of the projection may be gradually increased from one portion adjacent to the propeller or the impeller toward the other portion opposite to the one portion adjacent to the propeller or the impeller.

In the present invention, the projections may be formed into multiple stages along the vertical direction, the horizontal direction, or both directions of the container, and the stages of the projections may be spaced from each other.

In the present invention, the number of stages may be 2 to 10.

In the present invention, at least one of the number, the shape, the angle, the length, the height, the width of the projections, and the distance between the projections of one stage may differ from that of another stage.

The stirrer according to the present invention may further include a propeller or an impeller, and the number of the projections may be gradually increased or the distance between the projections may be gradually decreased from one stage adjacent to the propeller or the impeller toward the other stage opposite to the one stage adjacent to the propeller or the impeller.

In addition, the present invention provides a method for mixing substances using the stirrer described above.

Advantageous Effect

The structure of the grooves and the projections formed on the inner surface of the stirrer container, which is proposed by the present invention, gradually changes the flow in the rotational direction caused by the stirrer into the flow in the upward/downward direction so that the degree of vertical mixing can be enhanced. The concentration deviation in the stirrer generated by mixing fluids, which are initially placed at the lower portion and the upper portion in the stirrer, as time goes on, may be calculated to judge the degree of vertical mixing. As can be seen from FIG. 2, as compared with the stirrer on which no groove is formed, the concentration deviation is rapidly reduced and the vertical mixing is thus enhanced in the stirrer having the grooves formed on the inner surface of the stirrer container. Regarding the velocity distributions at the horizontal sectional planes shown in FIG. 3, it is possible to know that the velocity around the baffle in the stirrer having baffles provided therein is significantly reduced, but the velocity around the grooves formed on the inner surface of the stirrer container is maintained.

BRIEF DESCRIPTION OF THE DRAWINGS

FIG. 2 is a graph for comparing a normalized concentration standard deviation of a stirrer on which no groove is formed with a normalized concentration standard deviation of a stirrer on which grooves are formed, as time goes on.

BEST MODE FOR CARRYING OUT THE INVENTION

Hereinafter, the present invention will be described in more detail with reference to the accompanying drawings.

Figure 1:
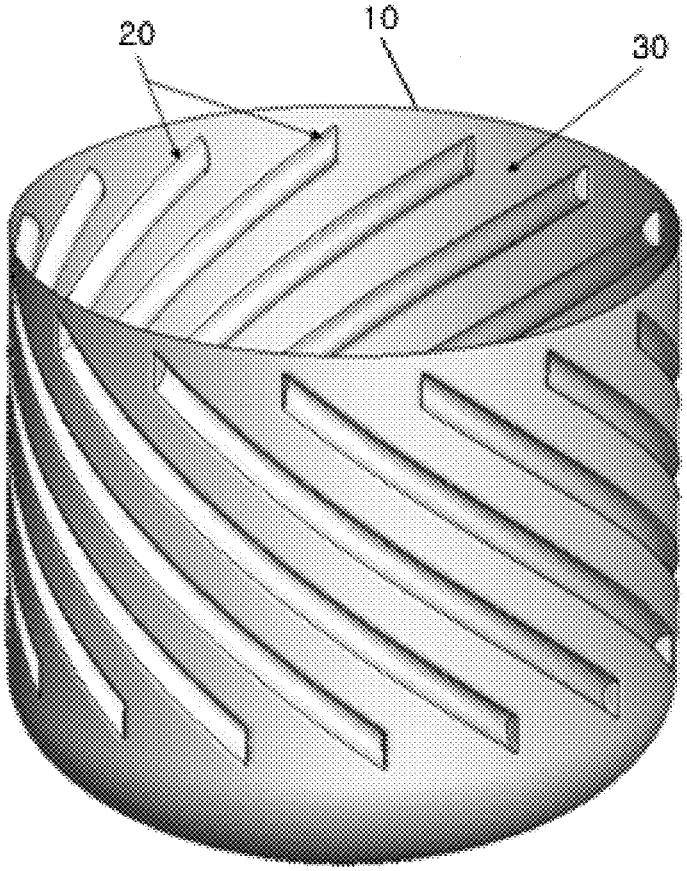
FIG. 1 is a perspective view of a stirrer according to one embodiment of the present invention.

FIG. 1 is a perspective view of a stirrer according to one embodiment of the present invention, and the stirrer may include a stirrer container 10, a plurality of projections 20 formed on an inner surface of the stirrer container 10, and a plurality of grooves 30, each of which being formed between the projections 20. In addition, the stirrer may be equipped with a mechanical mixing means including a propeller, an impeller, a turbine, and a motor for driving the above elements. In addition to the above, the stirrer may be equipped with installations or equipment which has been conventionally installed. For the sake of simplicity, however, the above installation or equipment elements are omitted from the drawing.

The stirrer container 10 may be formed of metal, plastic, ceramic, and the like. In general, the stirrer container 10 may have a cylindrical shape as shown in the drawing. However, the shape of the container 10 is not limited to the above, but may be variously modified as necessary.

The projection 20 is formed on the inner surface of the container 10. The projection 20 may be formed integrally with the container 10 or may be formed by means of a method such as a welding or an adhering. A material of the projection 20 may be the same as or different from that of the container 10.

The number of the projections 20 is not particularly limited, but at least two or more, preferably 8 or more projections may be formed. Although the drawings show that approximately 16 projections 20 are formed, the number of the projections 20 is not particularly limited, but may be variously adjusted as necessary. For example, the number of the projections 20 may be 2 to 100, preferably 4 to 50, and more preferably 8 to 36. If the number of the projections 20 is too low, an improvement effect of a degree of vertical mixing may be lowered. On the contrary, if there are too many projections, it is difficult to manufacture the container, and the improvement effect of the degree of vertical mixing is not increased any more or can even be lowered.

For example, a cross-sectional shape of the projection 20 may be a semi-circle or a semi-ellipse, and may be a polygon such as a quadrangle and triangle. Furthermore, the projection may have various cross-sectional shapes. In addition, the shape of the projection 20 may be independently formed. For example, the projections may be formed by combining the semi-circular sectional shaped projection and the semi-elliptical sectional shaped projection.

The terms used in the application, such as the semi-circle, the semi-ellipse, the polygon, and the like are not limited to the terms according to a strict geometrical definition, but should be interpreted as including an approximately semi-circle and semi-ellipse, and a shape which is similar to a polygon.

As described above, the cross-sectional shape of the projection 20 is not particular limited, but may be variously constructed. In order to distinguish the projection from a conventional plate-shaped baffle in the shape, to minimize a deformation of an internal flow pattern of the stirrer, to prevent a generation of a flow stagnation region, and to improve the degree of vertical mixing of the stirrer, it is preferable for the projection to have the semi-circular or semi-elliptical cross-sectional shape formed by a curve, rather than a polygonal cross-sectional shape. In particular, it is more preferable for the projection to have the semi-circular cross-sectional shape shown in the drawing to obtain the effect as described above.

The projection 20 may have a linear longitudinal shape or a curved longitudinal shape, and may be formed by mixing a linear region and a curved region. As shown in the drawing, the projection 20 may be spirally arranged along the inner surface of the cylindrical container 10. By spirally arranging each projection 20, the improvement effect of the degree of vertical mixing can be maximized.

The projection 20 may be inclined with respect to a vertical plane of the container 10. Here, the vertical plane may mean an imaginary plane extending in the vertical direction (upward/downward direction) of the container 10. As such, due to the inclined projection 20, the improvement effect of the degree of vertical mixing can be further increased. The above spiral shape is also obtained by the inclined projection 20.

An angle between the projection 20 and the vertical plane of the container 10 may be, for example, 10° to 70°, preferably 20° to 60°, and more preferably 30° to 50°. If the above angle is too small or too large, the improvement effect of the degree of vertical mixing may be deteriorated. In addition, the above angle may be formed differently for each projection 20. As one example shown in the drawing, it is preferable that every projection 20 have the same or similar angle to improve the degree of vertical mixing.

A length of each of the projections 20 may be independently selected, and the length of the projection 20 may be determined by the angle between the projection 20 and the vertical plane of the container 10 and a length of the container 10. Here, the length of the container 10 may mean a dimension in a vertical direction (upward/downward direction) and may mean a height if the container 10 has a cylindrical shape. The length of the projection 20 may mean a dimension in the longitudinal direction, that is, the direction of a portion having a maximum dimension. If the projection 20 is formed into the spiral shape, the length of the projection 20 may be greater than that of the container 10. The length of each projection 20 may be independently, for example, 75 to 500%, preferably 80 to 400%, and more preferably 85 to 300% of the length of the container 10. If the length of the projection 20 is too short, the improvement effect of the degree of vertical mixing may be deteriorated.

A height of each projection 20 may be independently, for example, 0.5 to 20% and preferably, 2 to 10% of a diameter of the container 10. If the height of the projection 20 is too small, the improvement effect of the degree of vertical mixing may be significantly reduced. On the contrary, if the height of the projection is too large, the improvement effect of the degree of vertical mixing is not increased any more or can even be lowered. Here, the diameter of the container 10 may mean a dimension in a horizontal direction and may mean an average diameter in the case in which the container does not have a cylindrical shape. In addition, the height of the projection 20 may mean a dimension of a portion protruding from the inner surface of the container 10, and may mean a maximum height of a portion which most protrudes from the inner surface. For example, the height of the semi-circular projection may mean the radius.

A width of each projection 20 may be independently 0.5 to 40% and preferably, 2 to 20% of the diameter of the container 10. If the width of the projection 20 is too small, the improvement effect of the degree of vertical mixing may be significantly reduced. On the contrary, if the width of the projection 20 is too large, the improvement effect of the degree of vertical mixing is not increased any more or can even be lowered. Here, the width of each projection 20 may mean a dimension of a portion extending along the inner surface of the container 10 in the circumferential direction.

A distance between the projections 20 may be 1 to 160%, preferably 5 to 40% of the diameter of the container 10. In addition, the distance between the projections 20 may be 50 to 1000%, preferably 80 to 300% of the width of the projection 20. If the distance between the projections 20 is too large, the improvement effect of the degree of vertical mixing may be significantly reduced. On the contrary, if the above distance is too small, the improvement effect of the degree of vertical mixing is not increased any more or can even be lowered.

The distance between the projections 20 may differ independently from another distance. However, as exemplarily shown in the drawing, it is preferable that the distances be almost the same or similar to each other and that the projections 20 be disposed in parallel with each other. In other words, it is advantageous and preferable to arrange the projections 20 at regular and parallel intervals in terms of a manufacturing aspect and an improvement of the degree of vertical mixing.

Each of the grooves 30 is naturally formed between the projections 20. In other words, the groove is not formed by artificially digging the inner surface of the container, but a space is formed between the projections by forming the projections 20 at predetermined intervals, and this space becomes naturally the groove 30. Therefore, a shape and a dimension of the groove 30 are closely related to the shape and dimension of the projection 20. That is, when the shape and dimension of the projection 20 are specified, the shape and dimension of the groove 30 may be determined in response to the shape and dimension of the projection. In particular, the distance between the projections 20 is an important factor for forming the groove 30, and if the distance between the projections 20 is excessively wide, the groove cannot be formed. In the conventional art, in particular, the groove is also formed on an inner surface of the container. In comparison with the width of the projection, however, the distance between the projections is too wide so that a space between the projections could not be regarded as the groove.

A width of the groove 30 may be 50 to 1000%, preferably 80 to 300% of the width of the projection 20. If the width of the groove 30 is too wide as compared with the width of the projection 20, the improvement effect of the degree of vertical mixing may be significantly reduced. Also, if the width of the groove is excessively wide, this groove cannot be regarded as the groove. On the contrary, if the width of the groove 30 is too narrow as compared with the width of the projection 20, the improvement effect of the degree of vertical mixing is not increased any more or can even be lowered.

The dimension and the shape of the projection 20 and the groove 30 may be independently and differently determined. For example, the projection 20 may be configured such that one portion, which corresponds to a lower portion of the stirrer at which a propeller or an impeller is provided according to the vertical direction of the stirrer, has small height and the height of the projection 20 may be gradually increased toward the other portion corresponding to an upper portion of the stirrer opposite to the lower portion at which the propeller or the impeller is provided. By the above configuration of the projection, the degree of mixing can be uniformized in the overall stirrer.

In addition, the projections 20 and the grooves 30 may be formed into multiple stages along the vertical direction and/or the horizontal direction of the container 10. The number of stages may be, for example, 2 to 10, and preferably, 2 to 5. In the case in which the projections and the grooves are formed into multiple stages, the projection 20 is not continuously and lengthily formed in the longitudinal direction, but may be cut off at intermediate portions to form discontinuously a plurality of projections at certain intervals. For example, a set of the projections 20 having a short length may be formed in the first stage and the next set of the projections 20 may be formed in the second stage, with the projections in the second stage being spaced apart from the projections in the first stage. Preferably, in the same set (stage), the number, the shape, the angle, the length, the height, the width, and/or the distance of the projection(s) 20 and/or the groove(s) 30 may be the same as those of other projection(s) and/or other groove(s). Preferably, the number, the shape, the angle, the length, the height, the width, and/or the distance of the projection(s) 20 and/or the groove(s) 30 in one stage may differ from those of the projection(s) and/or the groove(s) in another stage. Along the vertical direction of the container 10, for example, the number of the projections 20 is reduced or the distance between the projections is widened at the portion corresponding to the lower portion of the stirrer at which the propeller or the impeller is located, and the number of the projections 20 may be gradually increased or the distance between the projections may be gradually narrowed toward the other portion opposite to the portion corresponding to the lower portion of the stirrer at which the propeller or the impeller is located. As described above, in the case in which the container is constructed such that the number, the shape, and the dimension of the projections 20 and/or the grooves 30 in one stage differ from those in other stage, it is possible to obtain the uniform mixing effect in the overall stirrer by adjusting the number of the projections and/or the grooves and the distance between the projections or the grooves in each stage.

Meanwhile, as compared with the stirrer on which no projection 20 is formed, in the case in which the stirrer has the projections 20 formed thereon, an internal surface area of the stirrer is relatively increased so that a heat transferring area is also increased. Therefore, when the stirrer is heated or cooled, the heat transferring is efficiently performed due to an increase of a heat transferring area.

Also, the present invention provides a method for mixing substances using the stirrer described above. The substance to which the present invention is applied is not particularly limited. The present invention may be applied to fluid such as gas and liquid as well as solid. In addition, the present invention is applicable to gas-gas mixtures, gas-liquid mixtures, gas-solid mixtures, liquid-liquid mixtures, liquid-solid mixtures, solid-solid mixtures, and gas-liquid-solid mixtures. In addition, the present invention may be applied to solutions as well as all kinds of substances such as suspension, colloid, sol, gel, and the like.

In the present invention, as described above, by forming a plurality of projections and grooves having certain shape and dimension on the inner surface of the stirrer container, a flow in the rotational direction may be gradually changed into a flow in the upward/downward direction. In other words, the structure of the grooves and the projections formed on the inner surface of the stirrer container, which is proposed by the present invention, changes the flow in the rotational direction caused by the stirrer into the flow in the upward/downward direction so that the degree of vertical mixing can be enhanced.

A difference between the structure of the grooves/projections of the present invention and the conventional baffle structure is as follows. The conventional baffles are the plate-shaped structure which is stood and perpendicular to the rotational direction so that a rapid change of the internal flow is caused by the baffles. In the present invention, however, the shape of the inner surface of the container is modified so that it is advantageous in that the internal space of the container can be easily cleaned and the degree of mixing can be enhanced without any rapid change of the flow in the rotational direction and any protruding structure.

EXAMPLE

As shown in FIG. 1, approximately twenty projections 20 were spirally arranged along the inner surface of the container 10 to manufacture the stirrer on which the grooves 30 were formed. At this time, the stirrer was designed such that all the projections 20 had a semi-circular cross-sectional shape, the angle between the projection 20 and the vertical plane of the container 10 was approximately 36.5°, the length of the projection 20 was approximately 103% of the length of the container 10, the height of the projection 20 was approximately 3% of the diameter of the container 10, the width of the projection 20 was approximately 6% of the diameter the container 10, the distance between the projections 20 was approximately 20% of the diameter of the container 10, and the width of the groove 30 was approximately 194% of the width of the projection 20.

Comparative Example 1

The stirrer on which no groove and no projection is formed.

Comparative Example 2

The stirrer including four plate-shaped baffles which are perpendicularly formed on an inner surface of the container.

Experimental Example

Figure 2:
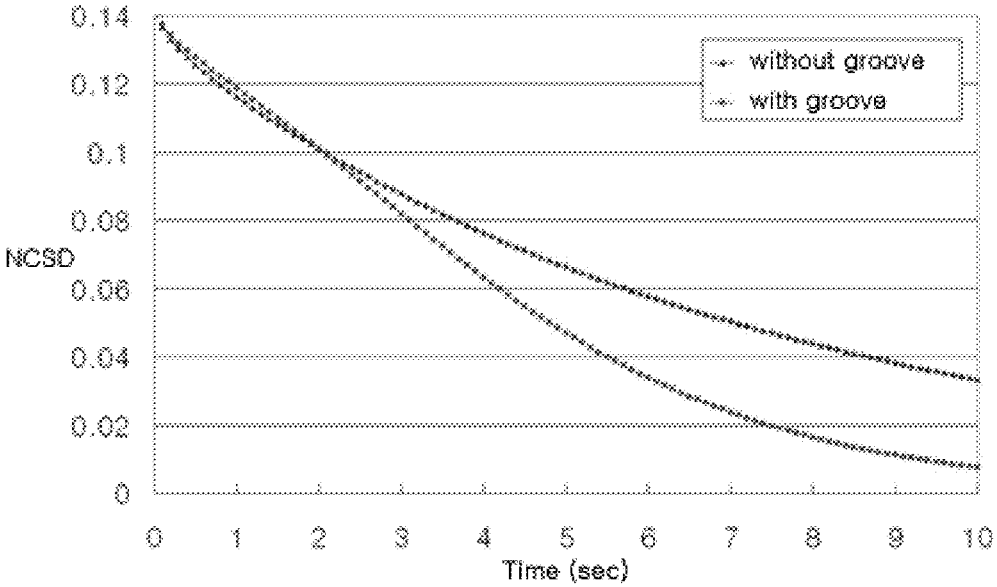

FIG. 2 is a graph for comparing a normalized concentration standard deviation (NCSD) of the stirrer (Comparative Example 1) on which no groove is formed with a normalized concentration standard deviation of the stirrer (Example) on which the grooves are formed, as time goes on.

The concentration deviation in the stirrer generated by mixing fluids, which were initially placed at the lower portion and the upper portion in the stirrer, as time goes on, may be calculated to judge the degree of vertical mixing. As can be seen from FIG. 2, as compared with the stirrer (Comparative Example 1) on which no groove was formed, the concentration deviation was rapidly reduced and the vertical mixing was thus enhanced in the stirrer (Example) having the grooves formed on the inner surface of the stirrer container.

Figure 3:
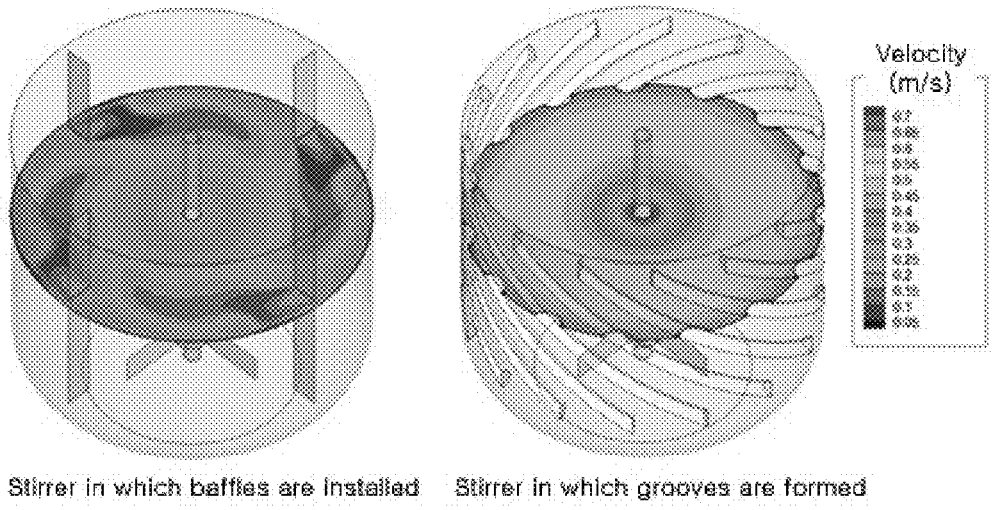
FIG. 3 is a mimetic diagram for comparing velocity distribution of a stirrer having baffles provided therein with velocity distribution of a stirrer on which grooves are formed.

FIG. 3 is a mimetic diagram for comparing velocity distribution of the stirrer (Comparative Example 2) having baffles provided therein with velocity distribution of the stirrer (Example) on which the grooves are formed.

Regarding the velocity distributions at the horizontal sectional planes shown in FIG. 3, it was possible to know that the velocity around the baffle of the stirrer (Comparative Example 2) having baffles provided therein was significantly reduced, but the velocity around the grooves formed on the inner surface of the stirrer container of the Example was maintained.

REFERENCE NUMERALS

10: Stirrer container
20: Projection
30: Groove

The invention claimed is:

1. A stirrer, comprising;

a stirrer container including a plurality of projections formed on an inner surface of the stirrer container;

a plurality of grooves, each of grooves being formed between the projections; and a propeller or an impeller positioned at a lower portion of the stirrer container, wherein the plurality of projections are spirally arranged, wherein each of the plurality of projections has a semi-circular cross-sectional shape, wherein each of the plurality of projections is independently inclined with respect to a vertical plane of the container, wherein an angle between each of the plurality of projections and the vertical plane of the container is 10 to 70°, wherein a width of each of the plurality of projections is independently 0.5 to 40% of a diameter of the container, wherein a distance between the projections is independently 1 to 160% of a diameter of the container, wherein a width of the plurality of grooves is 50 to 1000% of a width of the plurality of projections, wherein a height of the projections gradually increases from a first portion adjacent to the propeller or the impeller toward a second portion opposite to the first portion, and wherein a number of the projections gradually increases or a distance between the projections gradually decreases from the first portion toward the second portion.

2. The stirrer of claim 1, wherein a length of each of the plurality of projections is independently 75 to 500% of a length of the container.

3. The stirrer of claim 1, wherein a height of each of the plurality of projections is independently 0.5 to 20% of a diameter of the container.

4. The stirrer of claim 1, wherein the number of the projections is 2 to 100.

5. The stirrer of claim 1, wherein the projections are formed into multiple stages along the vertical direction, the horizontal direction, or both directions of the container, and the stages of the projections are spaced from each other.

6. The stirrer of claim 5, wherein the number of stages is 2 to 10.

7. The stirrer of claim 5, wherein at least one of the number, the shape, the angle, the length, the height, the width of the projections, and the distance between the projections of one stage differs from that of another stage.

8. A method for mixing substances using the stirrer according to claim 1.

* * * * *